US006193179B1

(12) United States Patent
Behrmann et al.

(10) Patent No.: US 6,193,179 B1
(45) Date of Patent: Feb. 27, 2001

(54) MACHINE FOR MILLING CEREALS, IN PARTICULAR RICE

(75) Inventors: Joachim Behrmann, Wentorf; Rolf Suhrbier, Hamburg; Michael Postel, Glinde; Thomas Strandt, Zeuthen, all of (DE)

(73) Assignee: F.H. Schule Muhlenbau GmbH (DE)

( * ) Notice: Subject to any disclaimer, the term of this patent is extended or adjusted under 35 U.S.C. 154(b) by 0 days.

(21) Appl. No.: 09/304,794

(22) Filed: May 4, 1999

(30) Foreign Application Priority Data

Nov. 12, 1998 (EP) ..... 98710016

(51) Int. Cl.[7] ..... B02C 9/00

(52) U.S. Cl. ..... 241/89.3; 241/246; 241/259.1; 241/261.1

(58) Field of Search ..... 99/519; 241/DIG. 30, 241/207–216, 261.1, 259.1, 259.2, 246, 89.3

(56) References Cited

U.S. PATENT DOCUMENTS

| | | | |
|---|---|---|---|
| 4,426,922 | 1/1984 | Yamamoto . | |
| 4,459,903 | 7/1984 | Yamamoto . | |
| 5,511,469 | 4/1996 | Satake et al. . | |
| 5,806,772 * | 9/1998 | Karra | 241/216 |

FOREIGN PATENT DOCUMENTS 2 323 766 10/1998 (GB) .

* cited by examiner

*Primary Examiner*—Mark Rosenbaum
(74) *Attorney, Agent, or Firm*—Alix, Yale & Ristas, LLP

(57) ABSTRACT

Machine for milling cereals, in particular rice, in an annular space (11) which has a vertical axis and is bounded on the outside by an outer casing (4), containing through-passages, and on the inside by a rotor (8), coaxial with respect to the same, and to which the milling material is fed by means of a positively driven conveyor (21). In order to increase the machine capacity along with the material being treated more gently, the outer casing (4) and the rotor (8) are frustoconical, the material is fed at the top, narrower end of the annular space (11), and the bottom end of the latter is provided with a compliant closure element (32).

10 Claims, 1 Drawing Sheet

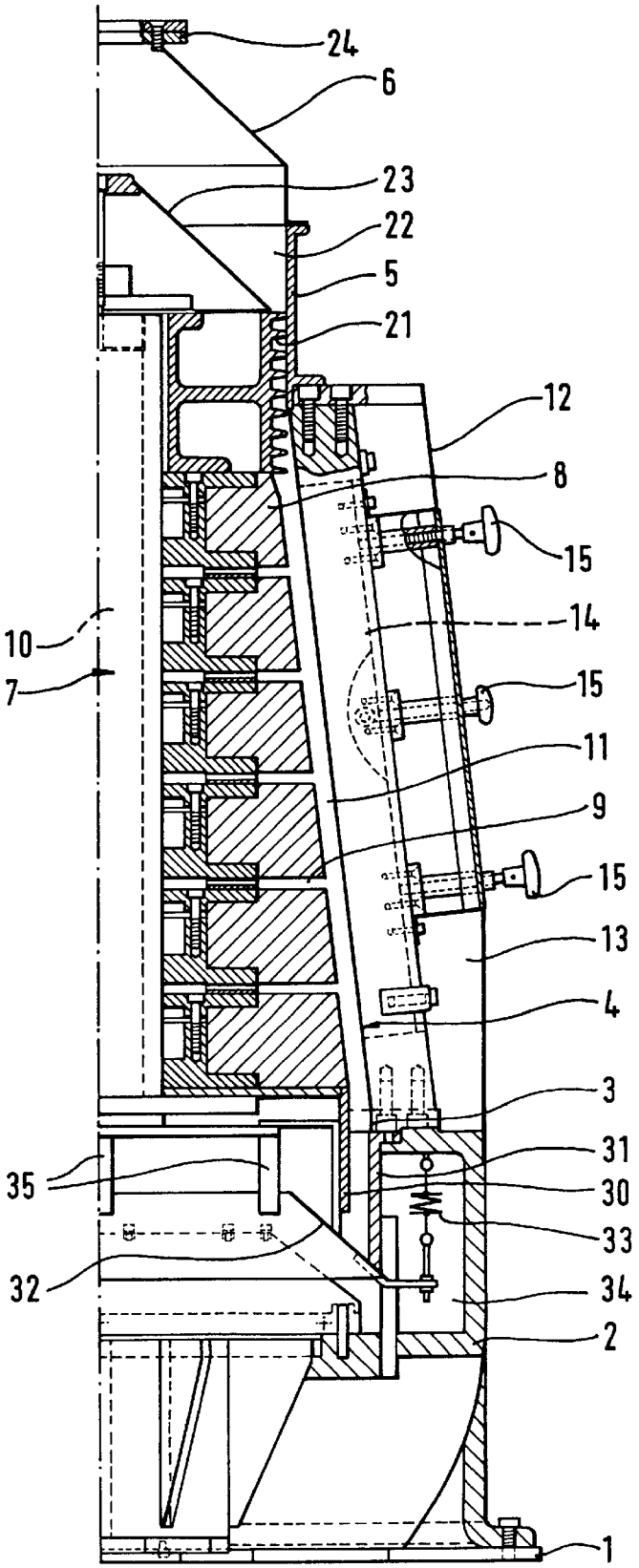
24
6
23
22
5
21
12
8
15
14
10
7
15
11
9
15
13
4
3
31
35
30
33
32
34
2
1

MACHINE FOR MILLING CEREALS, IN PARTICULAR RICE

BACKGROUND OF THE INVENTION

The invention relates to a machine for milling cereals, in particular rice, which belongs to the known type in which the milling material runs through an annular space which is bounded on the outside by an outer casing and on the inside by a milling rotor. The outer casing contains holes or slots through which the milled flour can emerge. The milling material is fed to the annular space at one end and led away from it at the other end. In the case of a known machine of this type (EP-B-521 452), the outer casing and the rotor are designed cylindrically and arranged vertically. The material is fed in a positively driven manner to the annular space at the bottom end by a screw conveyor. At the top end, the treated material emerges freely from the annular space. Filling of the annular space is ensured by the gravitational force, which is directed counter to the conveying direction. This arrangement has the disadvantage that the milling conditions cannot be adjusted optimally. It is not possible for the increase in the radial width of the annular space, said increase being caused by the gradual wear of the rotor, to be compensated for. Adaptation of the process parameters to different properties of the milling material is not possible.

This also applies in the case of known machines (prior public use) in which the cylindrical, vertically arranged annular space has material running through it from top to bottom. The material is fed merely by gravitational force, without any positively driven conveying operation. Its unobstructed emergence at the bottom end is prevented by a counterpressure disc, which closes off the bottom end of the annular space and can yield to the outlet pressure of the material, counter to a weight-loaded lever system. Experience shows that, despite the presence of the counterpressure disc, the annular space is not filled completely. As in the case of the abovementioned machine, the capacity is comparatively low, the broken fraction is high and a high temperature is also established.

Machines of which the annular space is designed conically are also known (prior public use). The material is fed, by gravitational force, to the top, large-diameter end. The bottom, small-diameter end is open. Complete filling of the working space, this filling being a prerequisite for high capacity, cannot be achieved. This disadvantage is not offset either by the advantage of the adjustability of the width of the annular space since, in the attempt to increase the capacity by reducing the width of the annular space, an excessively high working temperature is established. Reversing the cone arrangement does not provide improved properties either. Consequently, at the present time, high-quality manufacturers only provide machines with a cylindrical working space.

SUMMARY OF THE INVENTION

The object of the invention, while providing good adjustability of the process parameters to different materials, is to achieve a small broken fraction, low temperature and high capacity.

Accordingly, the machine is distinguished in that the small-diameter end of the conical annular space is arranged at the top. The radial width of the annular space can be adjusted by axial adjustment of the rotor. Despite the fact that material is fed from the top, a positively driven conveyor is provided. The bottom end is closed off by a compliantly yielding closure element.

It has been found that the working space (annular space) of this machine can be kept completely filled, and a high milling capacity, along with careful treatment of the material, is achieved.

The closure element, provided at the bottom end, is expediently formed by a frustoconical valve disc, which is referred to as counterpressure disc hereinbelow. The closure force of the latter is produced by springs. Unlike a weight-loaded counterpressure disc, in this case the mass of the parts which have to be moved by the emerging material can be kept low, with the result that it can react quickly to changing throughput conditions.

The positively driven conveyor is expediently formed by a conveying screw which is rotatably connected to the rotor and above which an upwardly widening supply space is arranged. The widening of this supply space can be brought about by a cone being positioned on the rotor or the screw.

According to a further feature of the invention, use is made, in conjunction with the machine, of a rotor which is known per se (EP-B 521 452) and has air-feed openings distributed over its length. Furthermore—as is likewise known—the working space may be provided with brake bars which run essentially in the longitudinal direction and can be adjusted radially in order for it to be possible to adjust the process parameters even more precisely.

The cone angle of the outer casing and of the rotor is expediently between 4 and 10°.

BRIEF DESCRIPTION OF THE DRAWING

The invention is explained in more detail hereinbelow with reference to the drawing, which schematically illustrates an advantageous exemplary embodiment in a longitudinal section of one half.

DESCRIPTION OF A PREFERRED EMBODIMENT

Rising up from the base plate 1, which may be designed as a box (not shown) for receiving further assemblies, is the base housing 2 of the rice-milling machine. Fastened on said base housing, at 3, is the bottom border of the conical outer casing 4, which is formed by a sheet-metal part which contains, in a known manner, regular holes or slots, of which the width is smaller than the size of the grains of rice. The cylindrical top housing 5, 6 rises up above the outer casing.

In the base housing or the box which forms the base plate 1, there are arranged, in a known manner (which is not illustrated specifically), a bearing and a drive for the rotor shaft 7, which extends coaxially in the outer casing 4 and, along with a series of slip rings, forms the rotor 8. The slip rings together form the conical surface of the rotor, said surface running parallel to, i.e. at constant radial distance from, the outer casing 4. Located between the individual slip rings are gaps 9 which have a flow connection with a channel 10 within the rotor shaft 7, said channel being connected to a fan (not shown). During the milling process, a strong air stream is blown out of the gaps 9 into the annular space 11. Said annular space 11 forms the working space of the machine.

The invention provides devices (not shown) which are intended for the axial adjustment of the rotor 8 with respect to the outer casing 4 and make it possible to adjust the radial width of the working space 11, depending on the type of material treated and the extent to which the rotor 8 is worn.

The outer casing 4 is surrounded by a housing 12, which together with the outer casing 4 encloses a space 13.

Produced within said space is a strong air stream which leads away the milled flour which passes into the space 13 from the working space 11 through the openings in the outer casing 4.

The outer casing 4 contains slots which run in the direction of the surface lines, are located in a common plane with the axis of the rotor shaft 7 and in which there are located brake bars 14 which can be pushed radially into the annular space 11 to a more or less pronounced extent by adjusting screws 15 in order to curb the circulatory movement of the milling material in an adjustable manner. For example, four such brake bars are arranged over the circumference.

Above the rotor 8, the rotor shaft 7 bears a screw conveyor 21 which has conveying windings and conveys the milling material in a positively driven manner out of the space 22, arranged above it, into the working space 11 as the rotor moves. In the space 22, the material flows to the inlet opening of the screw conveyor 21 under its own dead weight, guidance being provided by the wall of the top housing and by a cone 23 positioned on the conveyor 21. Said cone rotates with the rotor. The result of the movement thus transmitted to the material which is in contact means that said material always flows uniformly to the inlet side of the conveyor.

At the top end, the top-housing part 6 forms a flange 24 for the connection of a material-feed line, if appropriate with the inclusion of a shut-off or throttling element.

The rotor 8 is terminated at the bottom by an inner cylindrical collar 30, which is surrounded by an outer cylindrical collar 31 of the base housing, said collar 31 projecting beyond the collar 30 in the downward direction. The treated material passes out of the working space 11 by way of the annular space enclosed between the cylindrical collars 30, 31. In this case, the material is subjected to a positive pressure brought about, on the one hand, by the positively driven conveyor 20, 21 and, on the other hand, by the conical widening of the working space 11. The bottom border of the outer collar 31 interacts with a frustoconical sheet-metal ring 32 which is drawn upwards against the bottom border of the outer collar 31 by circumferentially distributed springs 33. The sheet-metal ring 32 forms the counterpressure disc which closes off the bottom end of the working space 11 and is raised, counter to the force of the springs 33, by the pressure of the material emerging between the cylindrical collars 30, 31, in order to discharge the material into the adjoining space 34 of the base housing. From there, the material can flow away or be conveyed away.

The inner collar 30 need not extend down as far as the counterpressure disc. Moreover, so that there is sufficient three-dimensional freedom for the axial adjustment of the rotor in relation to the outer casing 4, this is generally not desirable. It is possible to connect to the counterpressure disc 32 guide arms 35 which interact with the rotor shaft 7, the inner collar 30 or any other part of the machine for the purpose of axially guiding the counterpressure disc 32.

The cone angle of the outer casing 4 and of the rotor 8, i.e. the angle between diametrically opposite surface lines of these parts, is expediently in the order of magnitude of 6°.

What is claimed is:

1. A machine for milling cereals, said machine comprising:

a frusto conical outer casing, said outer casing having a vertical central axis and a plurality of through-passages, said outer casing having an increasing diameter from a first end to a second end;

a frusto conical rotor, said rotor having an increasing diameter from a first end to a second end, said rotor being rotatably mounted within said outer casing so that said outer casing first end surrounds said rotor first end, said outer casing being coaxial with said rotor and defining an annular space between said outer casing and said rotor, said annular space having a radial extent defined between said outer casing and said rotor;

adjusting means for adjusting the axial relationship between said outer casing and said rotor;

a positively driven conveyor mounted to said outer casing first end; and a closure element mounted generally adjacent to said outer casing second end, said resilient closure defining an axial limit of said annular space, wherein cereal to be milled is positively fed into said annular space by said conveyor and an adjustment of the axial relationship between said outer casing and said rotor produces a corresponding adjustment of the radial extent of said annular space.

2. The machine of claim 1, wherein said closure element is formed by a resiliently supported frusto conical valve disc.

3. The machine of claim 1, wherein said closure element comprises adjustable resilient support means for exerting an adjustable resilient supporting force on said closure element.

4. The machine of claim 1, wherein said conveyor comprises a conveying screw which is connected to said rotor for rotation therewith, said screw having a second end generally adjacent said outer casing first end and an axially opposed first end, means for providing a supply space being arranged adjacent said screw first end.

5. The machine of claim 4, wherein said means for providing a supply space is conical in shape having a narrow end with the narrow end of said conical shape disposed adjacent to said screw first end.

6. The machine of claim 1, wherein said rotor comprises an axial length and air feed openings are distributed over the length of said rotor.

7. The machine of claim 1, wherein said outer casing comprises a plurality of axially oriented brake bars and a corresponding plurality of complementary axially oriented slots, said brake bars configured to pass through said slots to radially protrude into said annular space.

8. The machine of claim 7, wherein said brake bars comprise adjustment means for adjusting the radial protrusion of said brake bars into said annular space.

9. The machine of claim 1, wherein said outer casing includes a frusto conical inner surface and said rotor includes a frusto conical outer surface, said frusto conical outer casing inner surface and said frusto conical rotor outer surface each forming a substantially equal conical angle with respect to said vertical axis.

10. The machine of claim 9, wherein said conical angle is between 4 and 10 degrees.

* * * * *